US005338591A

United States Patent [19]

Pöll

[11] Patent Number: 5,338,591

[45] Date of Patent: Aug. 16, 1994

[54] DECORATIVE ELEMENT HAVING A PLURALITY OF GEMS AND A METHOD FOR PRODUCING IT

[75] Inventor: Martin Pöll, Fritzens, Austria

[73] Assignee: D. Swarovski & Co., Wattens, Austria

[21] Appl. No.: 65,463

[22] Filed: May 21, 1993

Related U.S. Application Data

[63] Continuation of Ser. No. 827,379, Jan. 29, 1992, abandoned.

[30] Foreign Application Priority Data

Feb. 13, 1991 [DE] Fed. Rep. of Germany ..... 4104337

[51] Int. Cl.[5] ..... B32B 3/16

[52] U.S. Cl. ..... 428/67; 428/220; 63/28

[58] Field of Search ..... 428/67, 220; 63/26, 63/28

[56] References Cited

U.S. PATENT DOCUMENTS 4,936,116 6/1990 Poll ..... 63/28

*Primary Examiner*—Alexander S. Thomas

*Attorney, Agent, or Firm*—Fay, Sharpe, Beall, Fagan, Minnich & McKee

[57] ABSTRACT

The invention relates to a decorative element having a plurality of gems which are held in a carrier. The carrier comprises:

a) an upper impressible layer;

b) a lower impressible layer; and, c) an irreversibly deformable layer disposed between the layers. The layers are stuck together and the gems are pressed into the carrier from above in an ornamental arrangement. Optionally, the side of the carrier bearing the gems additionally bears an effect layer.

14 Claims, 1 Drawing Sheet

DECORATIVE ELEMENT HAVING A PLURALITY OF GEMS AND A METHOD FOR PRODUCING IT

This is a continuation of co-pending application Ser. No. 827,379 filed on Jan. 29, 1992 now abandoned.

BACKGROUND OF THE INVENTION

1. Field of the Invention

The invention relates to a decorative element having a plurality of gems which are held in a multilayer carrier and to a method for producing it.

2. Description of the Related Art

Decorative elements haying a plurality of gems, also known as compounds of gems are already known. For example, Austrian patent no. 338 020 describes a compound of gems wherein a plurality of gems are combined by means of a hot-melt adhesive layer which embraces the setting side of the gems. A disadvantage of this known gem compound is that when it is applied to a flat, unimpressible surface of a substrate the hot-melt adhesive layer connects with the substrate surface only at the lower gem tip, obtaining poor adhesion therewith.

The disadvantages of this compound of gems were eliminated by covering the setting side of the gems with a plurality of layers, particularly the last of which is flat. According to German patent no. 38 20 250 the setting side of the gems therefore bears a first hot-melt adhesive layer, followed by a filling layer which fills in the spaces between the individual gems, and therebelow a second hot-melt adhesive layer which is substantially flat.

The first hot-melt adhesive layer is welded with the second hot-melt adhesive layer in the area of the tips of the gems.

The compound of gems described above can be produced only with high labor consumption. This is in particular due to the fact that during its production the two melt adhesive layers must be heated and even welded together for fixing the gems and for interconnecting the layers. The production of the known compound of gems is therefore labor-intensive and expensive. Furthermore, the application of an uppermost effect layer between the gems is complicated and restricted.

SUMMARY OF THE INVENTION

The present invention is based on the problem of overcoming the disadvantages known from the prior art, in particular of simplifying and simultaneously improving the fixation of the gems.

The invention is based on the finding that the gems can be held in the multilayer carrier if the latter has a stabilizing layer.

The object of the invention is thus a decorative element having a plurality of gems which are held in a carrier, characterized in that the carrier comprises an upper impressible layer, a lower impressible layer, and an irreversibly deformable layer disposed between said layers, the layers being adhesively interconnected, the gems being pressed into the carrier from above in an ornamental arrangement, and the irreversibly deformable layer being a layer which assumes the form of the setting side of the gems when the latter are pressed in.

The object of the invention is also a method for producing a decorative element by producing a carrier by adhesively connecting layers and pressing gems into the carrier from the top in an ornamental arrangement at least as far as their equator, characterized in that an irreversibly deformable layer is disposed between an upper impressible layer and a lower impressible layer, said deformable layer assuming the form of the setting side of the gems when the latter are pressed in.

The inventive decorative element having a plurality of gems is characterized by having a carrier which has a simple structure and is thus easy and inexpensive to produce. It is simultaneously ensured that the gems are held captively in the carrier by the irreversibly deformable layer reproducing the form of the setting side of the gems in some areas of the carrier, so that the gems are firmly mounted. No energy need be expended to produce the decorative element or to stick the individual carrier layers together.

The inventive decorative element is readily deformable and can thus be easily adapted to all types of surfaces. This is due to the fact that all layers of the carrier, including the irreversibly deformable layer, are very flexible. The inventive decorative element is very thin despite the layer carrier, which makes it applicable for many purposes. The gems are mounted in the inventively used carrier with high shock absorption so that the decorative element also withstands considerable mechanical loads.

To avoid unnecessarily increasing the thickness of the decorative element, the upper impressible layer preferably has a smaller thickness than the lower layer. The upper impressible layer preferably has a thickness of about 0.1 to 0.2 mm. The thickness of the lower impressible layer is variable, however, depending on the size of the gems to be inserted. In particular, the thickness of the lower impressible layer must have approximately the height of the mounting portion of the gem, i.e. the setting side of the gem.

In a particularly favorable embodiment of the present invention the impressible layers are self-adhesive on at least one side so that they can be stuck to the next layer by mere compression. In a particularly suitable way, however, these layers are provided with a self-adhesive layer on both sides. In this embodiment the carrier for the inventive decorative element is particularly simple to produce.

In a further preferred embodiment the impressible layers are made of a compression-elastic material, i.e. a material which resumes its original form after compression. This ensures in particular that the gems can be held shockproof in the carrier material.

The compression-elastic material used is suitably a foamed material or nonwoven fabric which can also carry a self-adhesive layer. In particular a layer of acrylic foam is suitable as a compression-elastic layer.

A great variety of materials can be used for the irreversibly deformable layer. Suitable ones are all irreversibly deformable plastics. In a particularly preferred embodiment, however, aluminum is used for this layer. Aluminum can be used in particularly thin layers, is elastic and easily deformable and this deformability is irreversible.

The gems used may in particular be cut glass stones, preferably chatons of crystal glass.

During production of the inventive decorative element the carrier is preferably stamped into the desired form before the gems are pressed into it.

BRIEF DESCRIPTION OF THE DRAWING

The invention shall be explained in more detail below with reference to the drawing which shows a preferred embodiment of the present invention.

DESCRIPTION OF THE PREFERRED EMBODIMENTS

Figure 1:
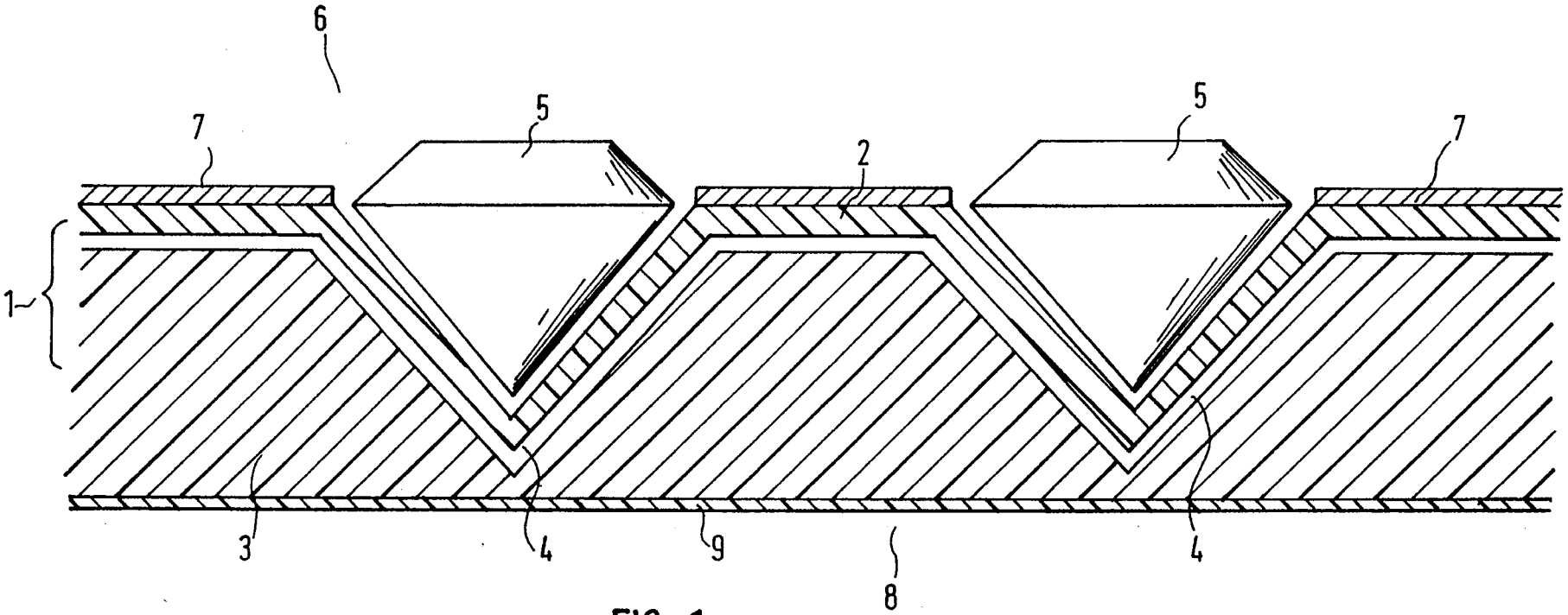
FIG. 1 shows a schematic view or sectional view of a preferred embodiment of a decorative element according to the invention.

In the embodiment shown, gems 5 are embedded in a three-layer carrier 1. The carrier is formed of a lower layer 3, an intermediate layer 4 and an upper layer 2. On upper side 6 of the decorative element, i.e. on upper layer 2, an effect layer 7 is applied. Underside 8 of the decorative element, i.e. lower layer 3, is covered with a separation layer 8.

Lower layer 3 and upper layer 2 of the carrier are made of an impressible material. Impressible materials to be used are in particular-all foamed materials and nonwoven fabrics, e.g. acrylic foam. Commercially available mounting bands made of Moltopren® foam are particularly suitable; they can be provided suitably with a self-adhesive layer on both sides. The use of such self-adhesive mounting bands as impressible layers makes the production of the carrier particularly simple. Upper layer 2 can also be designed as an adhesive layer.

In order to minimize the total thickness of the decorative element, upper layer 2 is made thinner than lower layer 3. The thickness of the upper layer is preferably 0.1 to 0.2 mm. It serves in particular to encase gem 5 and to fix it to carrier 1. Upper layer 2 is not penetrated by the gem tip so that gem 5 is connected only with upper layer 2 and not with one of layers 3 and 4 located therebelow. The thickness of layer 3 is selected depending on the size of gem 5 used. It serves substantially to take up the gem tip and to protect it, whereby the gem tip remains encased by intermediate layer 4 and upper layer 2. This simultaneously obtains a flat underside 8 of carrier 1. Depending on the size of the gem means that the lower layer must have at least a thickness corresponding to the dimension of the gem between its tip and its equator. It is about 0.8 mm for a gem (size PP 18) having a diameter of 2.5 mm.

Intermediate layer 4 is made of an irreversibly deformable material. Many materials are suitable which do not automatically resume their original form after deformation, such as almost all soft plastics. It is preferable to use an aluminum layer, however. The thickness of this aluminum layer can be very small, for example 0.01 mm. The irreversibly deformable layer causes carrier 1 to be stabilized when gems are pressed into it. The irreversibly deformable layer assumes the form of the underside, i.e. the setting side, of the gems and retains it even when no more pressure is exerted. Its adhesion with the impressible layers simultaneously causes their lasting deformation in the area of the gem setting side. The result is a simple and stable mounting for gems 5.

Gems 5 are preferably cut glass stones, in particular chatons made of crystal glass. They are stuck to the carrier when being pressed into it. This is done in a particularly simple way when upper layer 2 is made of material which is self-adhesive on both sides. However, an adhesive layer can also have been applied to upper side 6 of the carrier before gems 5 are pressed into carrier 1.

Effect layer 7 has the purpose of giving the spaces between gems 5 a preferred optical appearance when viewed from the top, i.e. of improving the esthetic effect of the decorative element and giving it a variable design. It may cover unsightly layers located therebelow. Such an effect layer can be omitted, however, if the optical appearance of upper layer 2 is satisfactory. If gems 5 are stuck to the carrier via a specially applied adhesive layer, it is conceivable, for example, to dye this adhesive. Upper layer 2 of the carrier can also be already dyed itself.

If an additional effect layer is applied it is suitable to use any dry coating material which can be screened onto the carrier or applied electrostatically to it after the gems are pressed in. Such a material is e.g. tinsel made of plastics or metal of any color, such as ballotini.

The application and fixation of the effect layer is again particularly simple if upper layer 2 is made of a double-sided self-adhesive material. The screened on or electrostatically applied effect material then sticks only to upper layer 2 and not to the impressed gems.

Separation layer 9 is for storing the decorative element until it is applied. It is made of paper or plastics, preferably silicone-coated paper.

When producing the inventive decorative element one generally first prefabricates carrier 1 and stamps the desired forms for the decorative element out of the prefabricated layer carrier. The gems are held on a transfer film in the desired ornamental arrangement. This transfer film is a adhesive film on which the gems are held with their visible side. The transfer film with the gems sticking thereto is now brought with suitable means precisely over the individual carrier elements and the gems are pressed in with their tips first at least as far as their equator. When the transfer film is removed the gems remain in the layer carrier to which they are adhesively connected. However, the gems can also be held in the desired arrangement on the pressure ram by a vacuum and be pressed in this way into the carrier layer. It is also conceivable to insert the gems and stamp out the desired form of the decorative element simultaneously.

The inventive decorative element is particularly suitable for jewelry production. The finished decorative elements can be easily inserted into bottom gem kettles made for example of metal or plastic forms. Particularly if lower layer 3 of the carrier is a double-sided adhesive layer the element can be stuck into a kettle without any great effort. Due to the great flexibility of the inventive decorative elements they can also be formed easily onto curved surfaces although they are originally flat. They are thus also suitable for application to textiles or leather, i.e. parts which are exposed to a certain degree of mechanical stress. This advantage is supported if layers 2 and 3 are made of foamed materials since the gems are then affixed with high shock absorption. The inventive decorative element can be produced very inexpensively, particularly in view of the high gem setting costs which are normally higher than the gem costs themselves.

I claim:

1. A decorative element having a plurality of gems which are held in a carrier, characterized in that the carrier (1) comprises a) an upper impressible layer (2), b) a lower impressible layer (3), and c) an irreversibly deformable layer (4) disposed between the layers (2, 3), the layers (2) (3) and (4)

being adhesively interconnected, the gems (5) being pressed into the carrier (1) from above in an ornamental arrangement, and the irreversibly deformable layer (4) being a layer which assumes the form of the setting side of the gems (5) when the latter are pressed in.

2. The decorative element of claim 1, characterized in that the side (6) of the carrier (1) bearing the gems (5) additionally bears an effect layer (7).

3. The decorative element of claim 2, characterized in that the upper layer (2) has a smaller thickness than the lower layer (3).

4. The decorative element of claim 3, characterized in that the upper layer (2) has a thickness between 0.1 and 0.2 mm.

5. The decorative element of claim 1, characterized in that the layers (2, 3) are self-adhesive on at least one side.

6. The decorative element of claim 1, characterized in that the layers (2, 3) are self-adhesive on both sides.

7. The decorative element of claim 1, characterized in that the layers (2, 3) are made of compression-elastic material.

8. The decorative element of claim 1, characterized in that at least one of the layers (2, 3) is made of foamed material.

9. The decorative element of claim 1, characterized in that at least one of the layers (2, 3) is made of acrylic foam.

10. The decorative element of claim 1, characterized in that at least one of the layers (2, 3) is made of nonwoven fabric.

11. The decorative element of claim 1, characterized in that at least one of the layers (2, 3) consists of self-adhesive mounting bands.

12. The decorative element of claim 1, characterized in that the layer (4) is made of aluminum.

13. The decorative element of claim 1, characterized in that the layer (4) is made of plastics.

14. The decorative element of, characterized in that the gems (5) are glass stones.

* * * * *